US007918520B2

(12) United States Patent
Nakamura

(10) Patent No.: US 7,918,520 B2
(45) Date of Patent: Apr. 5, 2011

(54) LIQUID DROP EXPELLING HEAD AND IMAGE FORMING DEVICE PROVIDED THEREWITH

(75) Inventor: Hirofumi Nakamura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 181 days.

(21) Appl. No.: 11/546,763

(22) Filed: Oct. 12, 2006

(65) Prior Publication Data

US 2007/0285448 A1 Dec. 13, 2007

(30) Foreign Application Priority Data

Jun. 12, 2006 (JP) ..... 2006-162087

(51) Int. Cl.
*B41J 29/38* (2006.01)
*B41J 2/045* (2006.01)

(52) U.S. Cl. ..... 347/10; 347/70

(58) Field of Classification Search ..... 347/70, 347/9, 10, 11, 68
See application file for complete search history.

(56) References Cited

U.S. PATENT DOCUMENTS 6,151,050 A * 11/2000 Hosono et al. ..... 347/70
6,354,685 B1 * 3/2002 Ohashi ..... 347/11
6,488,354 B2 * 12/2002 Hosono ..... 347/23

FOREIGN PATENT DOCUMENTS

JP 9-201960 8/1997

* cited by examiner

*Primary Examiner* — Matthew Luu
*Assistant Examiner* — Jannelle M Lebron
(74) *Attorney, Agent, or Firm* — Fildes & Outland, P.C.

(57) ABSTRACT

There is provided a liquid drop expelling head including: a driving element generating a pressure wave at a liquid within a pressure chamber, and expelling a liquid drop from a nozzle which communicates with the pressure chamber; and a control section applying a driving waveform based on image information to the driving element, and controlling a preparatory waveform, which vibrates a meniscus of the nozzle, on the basis of one of a liquid drop expulsion standby time and a liquid drop amount of a first drop at a time of starting expulsion again.

12 Claims, 8 Drawing Sheets

CONTROLLER
24
10
12
INK
40
16
28
44
29
57
50
48
46
44
60
62
54
52
58
42
32
16
38
36

LIQUID DROP EXPELLING HEAD AND IMAGE FORMING DEVICE PROVIDED THEREWITH

BACKGROUND

1. Technical Field

The present invention relates to a liquid drop expelling head which expels liquid drops, and to an image forming device provided with the liquid drop expelling head.

2. Related Art

Among liquid drop expelling heads of inkjet recording devices (hereinafter called "image forming devices"), there are those which impart vibration to the meniscus of the ink at the nozzle in order to prevent the ink from thickening (Japanese Patent Application Laid-Open (JP-A) No. 9-201960).

At times of liquid drop expulsion standby when a liquid drop is not being expelled from the nozzle, vibration is imparted intermittently to the meniscus of the nozzle to the extent that a liquid drop is not expelled therefrom. Further, vibration is continuously imparted to the meniscus immediately before printing begins.

In this way, by imparting vibration intermittently at the time of liquid drop expulsion standby and imparting vibration continuously before printing starts, fatigue and noise of the driving element are reduced, thickening of the ink is prevented, and clogging of the nozzle is prevented.

However, at this liquid drop expelling head, there is merely the structure of always applying the same vibration before printing starts, regardless of the extent of thickening of the ink or the expelling conditions of the ink drop to be expelled. Therefore, there are cases in which the effects of imparting vibration are insufficient, and cases in which, oppositely, the effects of imparting vibration are excessive.

In cases in which the effects of imparting vibration are insufficient, thickening of the meniscus surface progresses, and the problem arises that the expulsion speed of the first drop at the time of starting expulsion again is greatly reduced. However, in this case, because the thickened ink is removed due to the expulsion of the first drop, the expulsion speeds of the drops from the second drop on are hardly reduced at all.

On the other hand, in cases in which the effects of imparting vibration are excessive, the thickened ink is excessively dispersed within the ink flow path. Therefore, although the amount of reduction of the expulsion speed of the of the first drop is kept to a minimum, the dispersed thickened ink cannot be removed only in that first drop, and thus, there is the problem that the expulsion speeds of the ink drops from the second drop on as well are reduced.

In this way, problems arise both when the effects of meniscus vibration applied at times of expulsion standby are insufficient and when they are excessive.

SUMMARY

According to an aspect of the invention, there is provided a liquid drop expelling head including: a driving element generating a pressure wave at a liquid within a pressure chamber, and expelling a liquid drop from a nozzle which communicates with the pressure chamber; and a control section applying a driving waveform based on image information to the driving element, and controlling a preparatory waveform, which vibrates a meniscus of the nozzle, on the basis of one of a liquid drop expulsion standby time and a liquid drop amount of a first drop at a time of starting expulsion again.

BRIEF DESCRIPTION OF THE DRAWINGS

Exemplary embodiments of the present invention will be described in detail based on the following figures, wherein.

DETAILED DESCRIPTION

A first embodiment of an image forming device, in which a liquid drop expelling head of the present invention is employed, will be described in accordance with FIGS. 1 through 5.

Figure 5:
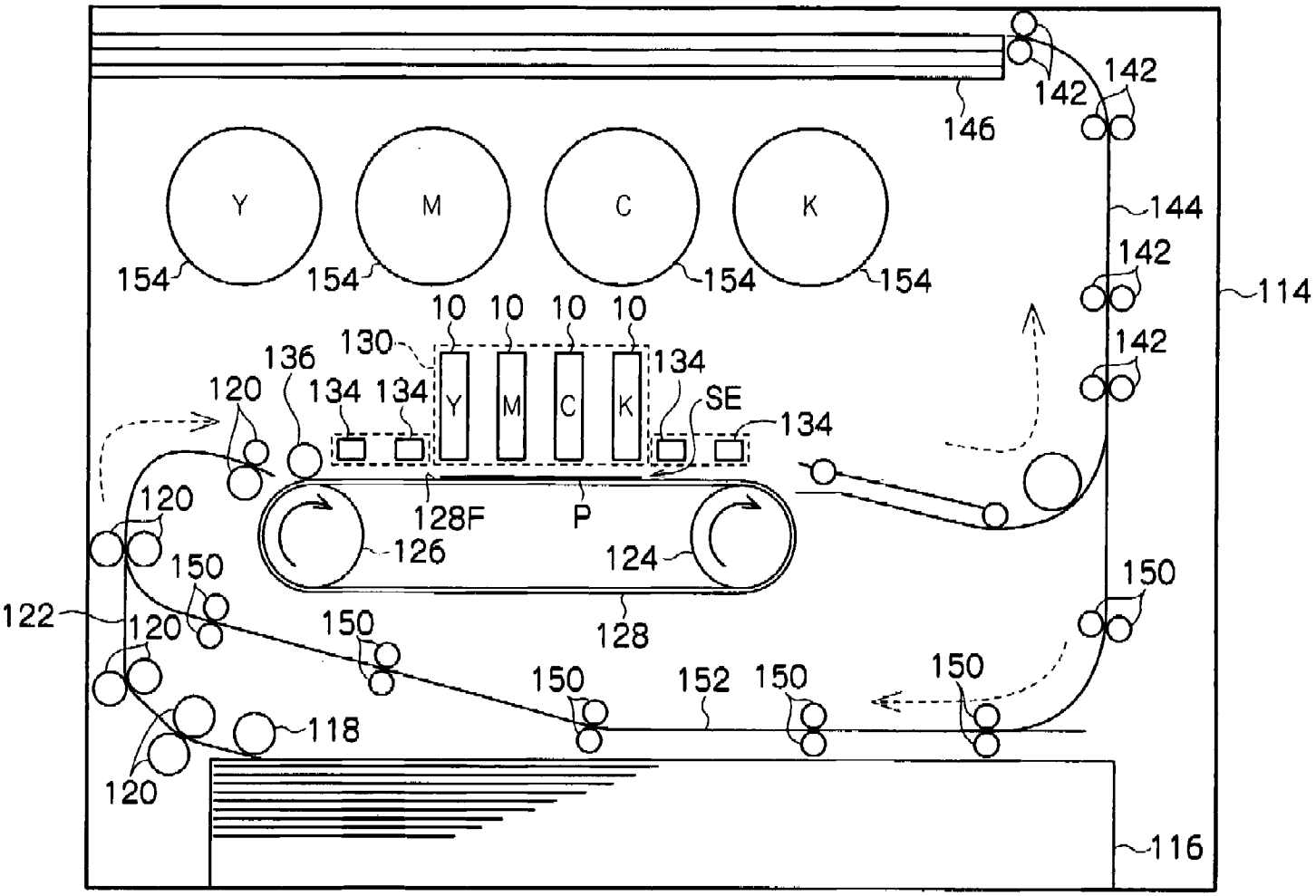
FIG. 5 is a schematic structural view of an inkjet recording device in which the inkjet recording head relating to the first embodiment is employed of the present invention.

As shown in FIG. 5, a sheet feed tray 116 is provided at the lower portion of the interior of a housing 114 of an inkjet recording device 110 serving as the image forming device. Sheets P which are stacked within the sheet feed tray 116 can be taken-out one-by-one by a pick-up roller 118. The sheet P which is taken-out is conveyed by plural conveying roller pairs 120 which structure a predetermined conveying path 122. Hereinafter, "conveying direction" refers to the direction of conveying the sheet P which is the recording medium, and "upstream" and "downstream" mean upstream and downstream in the conveying direction, respectively.

A conveying belt 128, which is endless and which is stretched around a driving roller 124 and a driven roller 126, is disposed above the sheet feed tray 116. A recording head array 130 is disposed above the conveying belt 128, and faces a flat portion 128F of the conveying belt 128. This facing region is an expulsion region SE where ink drops are expelled from the recording head array 130. In the state in which the sheet P, which has been conveyed along the conveying path 122, is held by the conveying belt 128 and reaches the expulsion region SE and faces the recording head array 130, ink drops corresponding to image information are adhered onto the sheet P from the recording head array 130.

Due to the sheet P being circulated in a state of being held by the conveying belt 128, the sheet P passes through the expulsion region SE plural times, such that so-called multipass image recording can be carried out. Accordingly, the surface of the conveying belt 128 is the path of circulation of the sheet P.

Four recording heads 10, which are elongated such that the effective recording regions thereof are at least as long as the width of the sheet P (the length of the sheet P in the direction orthogonal to the conveying direction thereof) and which serve as liquid drop expelling heads and which correspond to the four colors of yellow (Y), magenta (M), cyan (C), and black (K) respectively, are disposed at the recording head array 130 along the conveying direction, such that a full-color image can be recorded.

The recording head array 130 can be structured so as to be unable to move in the direction orthogonal to the conveying direction. However, if the recording head array 130 is structured so as to move when needed, in multipass image recording, images of higher resolutions can be recorded, and it is possible to make problems with the recording heads 10 not be reflected in the results of recording.

Four maintenance units 134, which correspond to the recording heads 10 respectively, are disposed in the vicinity of the recording head arrays 130 (in the present embodiment, at the both sides in the conveying direction). These maintenance units 134 carry out predetermined maintenance operations (vacuuming, dummy jetting, wiping, capping, and the like).

A charging roller 136 is disposed at the upstream side of the recording head array 130. The charging roller 136 can move between a pressing position, at which the charging roller 136 is driven while nipping the conveying belt 128 and the sheet P between itself and the driven roller 126 and presses the sheet P against the conveying belt 128, and a separated position at which the charging roller 136 is apart from the conveying belt 128. At the pressing position, a predetermined potential difference arises between the charging roller 136 and the driven roller 126 which is grounded, and therefore, charges are applied to the sheet P and the sheet P can be electrostatically attracted to the conveying belt 128.

An unillustrated peeling plate is disposed at the downstream side of the recording head array 130, and peels the sheet P off of the conveying belt 128.

The peeled-off sheet P is conveyed by plural discharging roller pairs 142 which structure a discharge path 144, and is discharged-out onto a catch tray 146 provided at the top portion of the housing 114.

An inverting path 152, which is structured by plural roller pairs 150 for inversion, is provided between the sheet feed tray 116 and the conveying belt 128. Due to the sheet P, on whose one surface thereof an image is recorded, being inverted and being held at the conveying belt 128, image recording onto the both surfaces of the sheet P can easily be carried out.

Ink tanks 154, which store inks of the four colors respectively, are provided between the conveying belt 128 and the catch tray 146. The inks in the ink tanks 154 are supplied to the recording head array 130 by ink supplying pipes (not shown).

Because the inkjet recording device 110 has the four recording heads 10 which house the inks of the four colors, the head widths in the conveying direction of the sheet P can be made to be small, and the recording head array 130 which is compact can be realized.

The structure of the recording head 10 will be described next.

Figure 3:
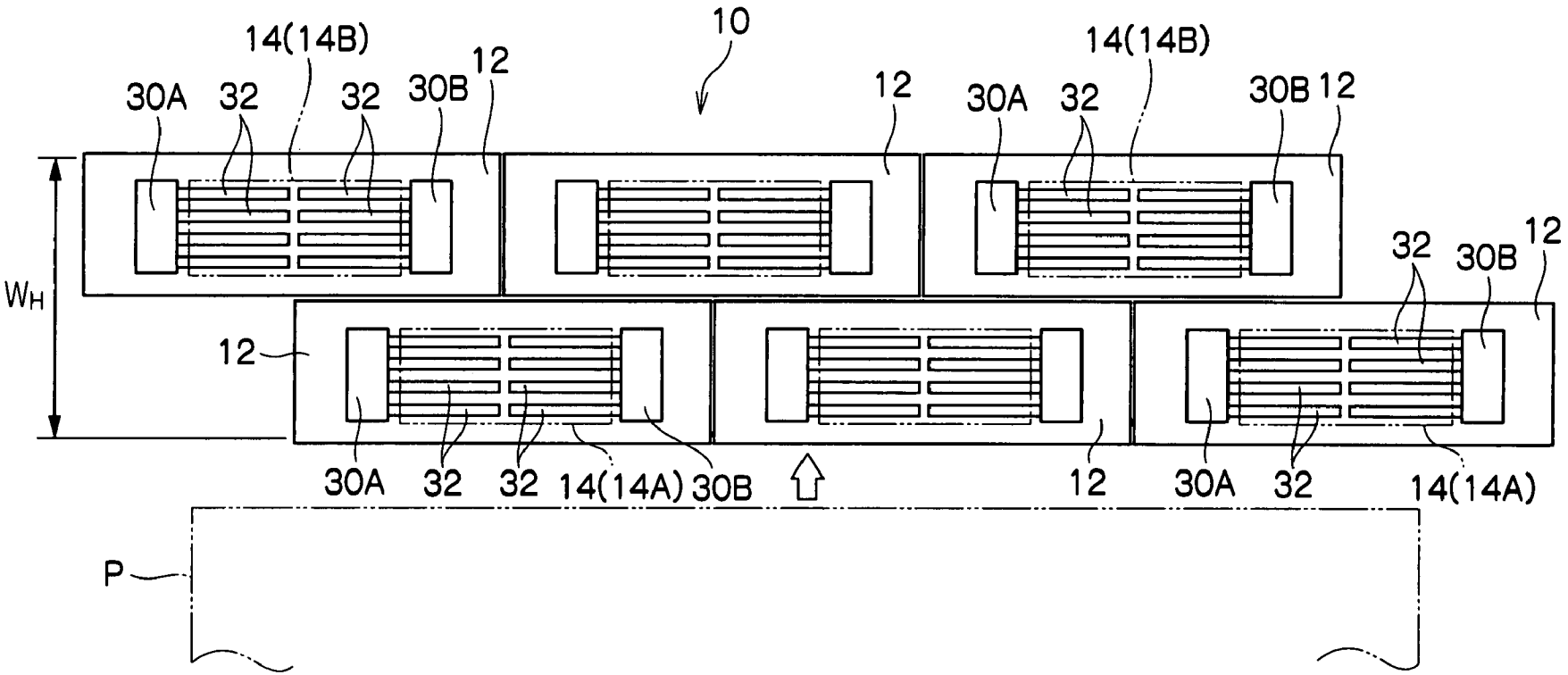
FIG. 3 is a plan view showing the recording head relating to the first embodiment of the present invention.

As shown in FIG. 3, the recording head 10 is formed by an elongated head which is wider than the maximum width of the sheet P. The recording head 10 is structured by plural head units 12 which are rectangular. The head units 12 are disposed in two rows in a staggered manner so as to be offset by a half of a pitch at the upstream side and the downstream side of the sheet P which is being conveyed.

A rectangular ejector region (ejector group placement portion) 14 is formed at the head unit 12. A plurality of ejectors 60, which have a pressure chamber 36, a nozzle communicating path 38, a nozzle 16, and a driving element 58 serving as a driving portion, which are shown in FIGS. 2A and 2B, are arrayed at the ejector region 14.

Figures 2A, 2B:
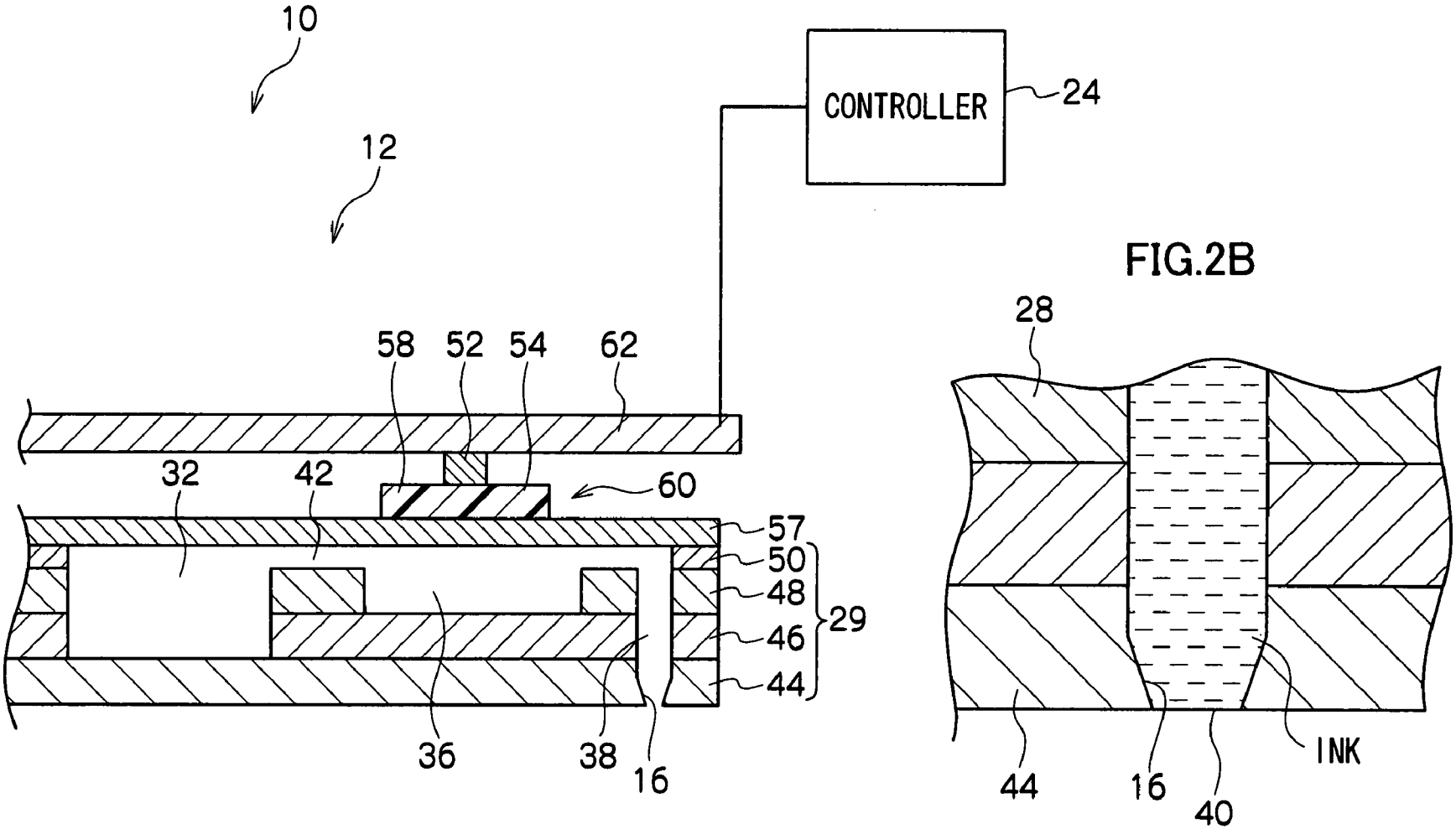
FIG. 2A is a cross-sectional view of the inkjet recording head relating to the first embodiment of the present invention.
FIG. 2B is an enlarged sectional view of a nozzle of the inkjet recording head relating to the first embodiment of the present invention.

In the inkjet recording device 110 (see FIG. 5) in which the recording head 10 is installed, the sheet P is conveyed in the direction of the arrow at a predetermined pitch at the portion facing the ejector regions 14 of the head units 12, and ink drops corresponding to image information are expelled from the nozzles 16 (see FIGS. 2A and 2B). Accordingly, regions, which are recorded by ejector regions 14A which are positioned at the sheet conveying direction upstream side of the recording head 10, and regions, which are recorded by ejector regions 14B which are positioned at the sheet conveying direction downstream side of the recording head 10, are lined-up alternately along the transverse direction of the sheet P on the sheet P at which image recording has been completed. Here, at the head units 12 which are adjacent to one another in the transverse direction of the sheet P which is being conveyed, the end portions of the ejector regions 14A, 14B are disposed so as to overlap one another, so that no region which cannot be printed arises within the printing region.

Figure 4:
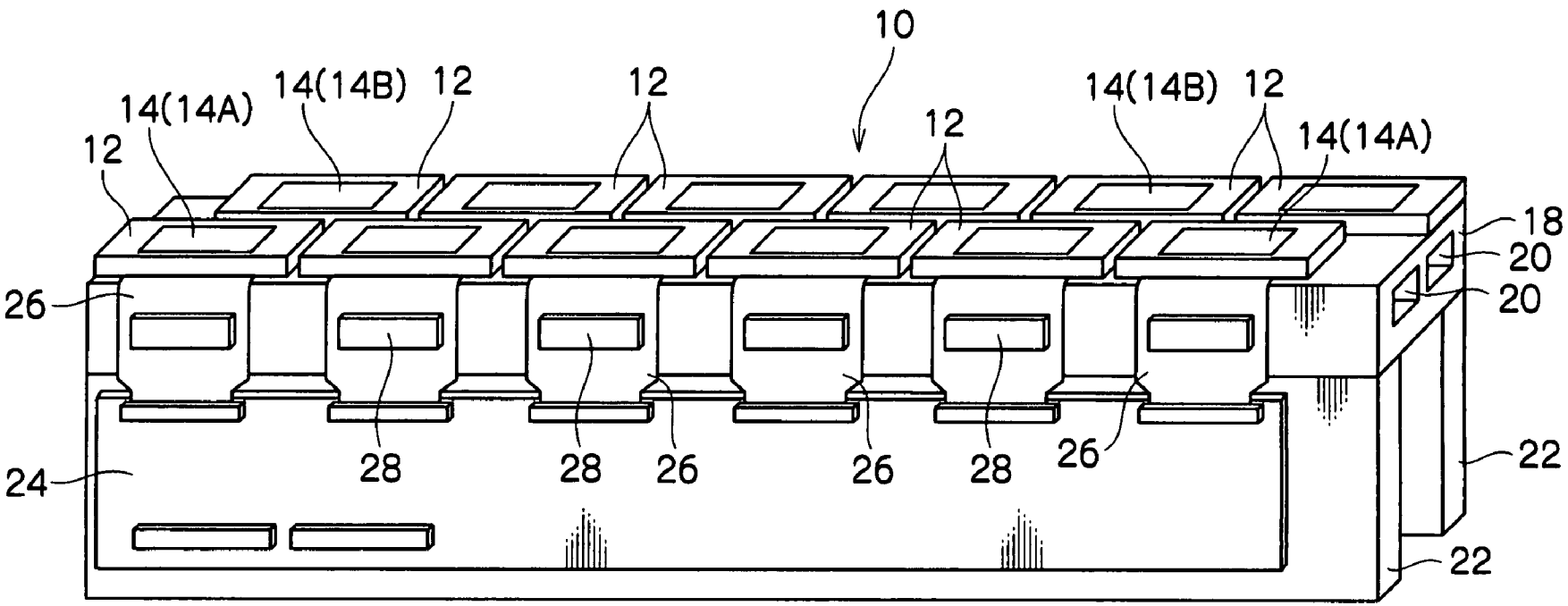
FIG. 4 is a perspective view showing the recording head relating to the first embodiment of the present invention.

As shown in FIG. 4, a base plate 18 which fixes the head units 12 is disposed at the sides of the head units 12 opposite the sides at which the ejector regions 14A, 14B are provided. Two ink flow paths 20, which supply ink to the two rows of the head units 12 respectively, are formed in the base plate 18. Further, two heat dissipating plates 22 are mounted to the end portions at the reverse surface side of the base plate 18. A controller 24, which controls the driving waveforms applied to driving elements 58, is disposed at the heat dissipating plate 22. Electric wires 26, which connect the respective head units 12 (at the near side in FIG. 4) and the controller 24, are supported at the side portion of the base plate 18. Switch ICs 28 are provided at the electric wires 26. Note that the electric wires 26 which are connected to the respective head units 12, the switch ICs 28, and the controller 24 are similarly provided at the far side in FIG. 4 although not illustrated.

As shown in FIG. 3, flow path main flows 30A, 30B are disposed at the outer sides of the both end portions of the ejector region 14, at the both end portions of the head unit 12. The flow path main flows 30A, 30B are connected to the ink flow path 20 (see FIG. 4), and ink is supplied from the ink flow path 20 through the flow path main flows 30A, 30B to the head unit 12. Plural common flow paths 32, which supply ink to the respective ejectors 60 arrayed at the ejector region 14, are connected to the flow path main flows 30A, 30B. The plural common flow paths 32 extend along the longitudinal direction from the both end portions of the head unit 12, and are divided at the central portion of the ejector region 14. Namely, the final end portions of the common flow paths 32 are positioned in a vicinity of the central portion of the head unit 12. Note that, for ease of understanding, FIG. 3 schematically illustrates four common flow paths 32 connected to the flow path main flows 30A, 30B. However, actually, the number of nozzles 16 (see FIGS. 2A, 2B) provided at the ejectors 60 is, for example, 600 npi (nozzle per inch), and a large number of common flow paths 32 is connected.

More specifically, as shown in FIGS. 2A and 2B, the nozzle communicating path 38 is provided at the side of the pressure chamber 36 at which side the nozzle 16 is provided, and the nozzle 16 and the pressure chamber 36 communicate with one another by the nozzle communicating path 38. On the other hand, the pressure chamber 36 and the common flow path 32 communicate with one another by a planar direction communicating path 42.

These are formed by laminating plural plates. A flow path plate unit 29 is formed by laminating, in order, a nozzle plate 44 in which the nozzles 16 are formed, an ink pool plate 46 in which the nozzle communicating paths 38 and the common flow paths 32 are formed, a pressure chamber plate 48 in which the pressure chambers 36 and the nozzle communicating paths 38 and the common flow paths 32 are formed, and a path plate 50 in which the planar direction communicating paths 42 are formed.

A vibrating plate 57 is adhered on the top surface of the path plate 50. The driving elements 58 are adhered on the top surface of the vibrating plate 57 at positions corresponding to the pressure chambers 36. The driving elements 58 are driving portions which deform due to the working of electrostriction, and apply pressure to the ink within the pressure chambers 36. A flexible circuit board 62 is joined via solder bumps 52 to upper portion electrodes 54 of the driving elements 58.

In accordance with this structure, the controller 24, which controls the driving waveforms applied to the driving elements 58, applies driving waveforms to the driving elements 58 via the flexible circuit board 62. Due to the driving elements 58 being driven thereby, pressure is applied to the ink filled in the pressure chambers 36, and the ink can be expelled from the nozzles 16.

Next, description will be given of the state after the liquid drop expulsion standby time, until expulsion is started again.

In cases in which there is an ink drop expulsion standby time in which ink is not expelled, the time over which a meniscus 40 (see FIG. 2B) of the nozzle 16 contacts the outside air is long, and the moisture in the ink evaporates from the meniscus 40. The viscosity of the ink in the vicinity of the meniscus 40 thereby increases, and there are cases in which the expulsion speed of the ink at the time expulsion starts again decreases and becomes off-target, and the image quality deteriorates.

Thus, in the present embodiment, on the basis of the length of the liquid drop expulsion standby time which is judged from the image information, the controller 24 controls the preparatory waveform which vibrates the meniscus 40 at the time of starting expulsion again, and applies this preparatory waveform to the driving element 58.

Figure 1A:
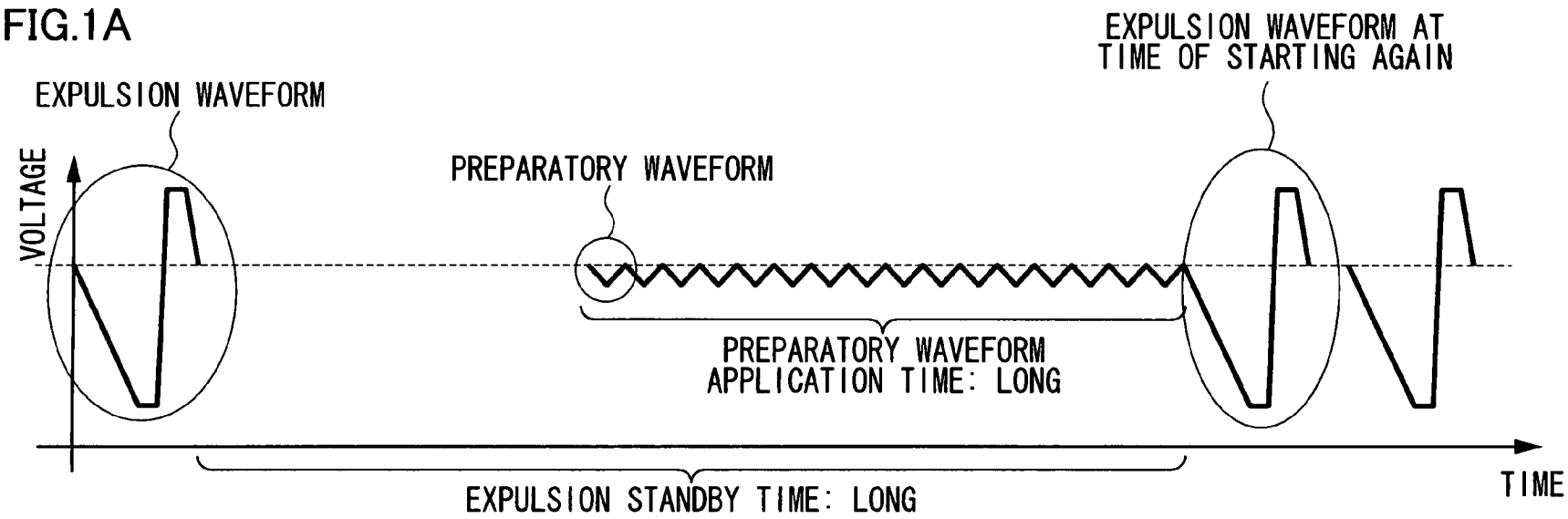
FIG. 1A is a drawing showing a preparatory waveform in a case in which the expulsion standby time is long, in an inkjet recording head relating to a first embodiment of the present invention.

Concretely, as shown in FIG. 1A, if the expulsion standby time is long, the viscosity of the ink in a vicinity of the meniscus 40 greatly increases, and therefore, the controller 24 applies a continuous preparatory waveform for a rather long time to the driving element 58 (see FIG. 2A). By sufficiently vibrating the meniscus 40 in this way, the expulsion speed of the first drop at the time of starting expulsion again is restored to 70% of the expulsion speed at the time of continuous expulsion. If the expulsion speed can be restored to 70%, image quality of a level which is equivalent to the image quality at the time of continuous expulsion can be obtained. Note that, although it would be ideal to return the expulsion speed to 100% (the continuous expulsion speed), the meniscus 40 would have to be vibrated greatly in order to return the expulsion speed of the first drop to the continuous expulsion speed, and as a result, the expulsion speeds of the drops from the second drop on would conversely decrease and the image quality would deteriorate. Therefore, 70% is desirable from an overall standpoint.

Figure 1B:
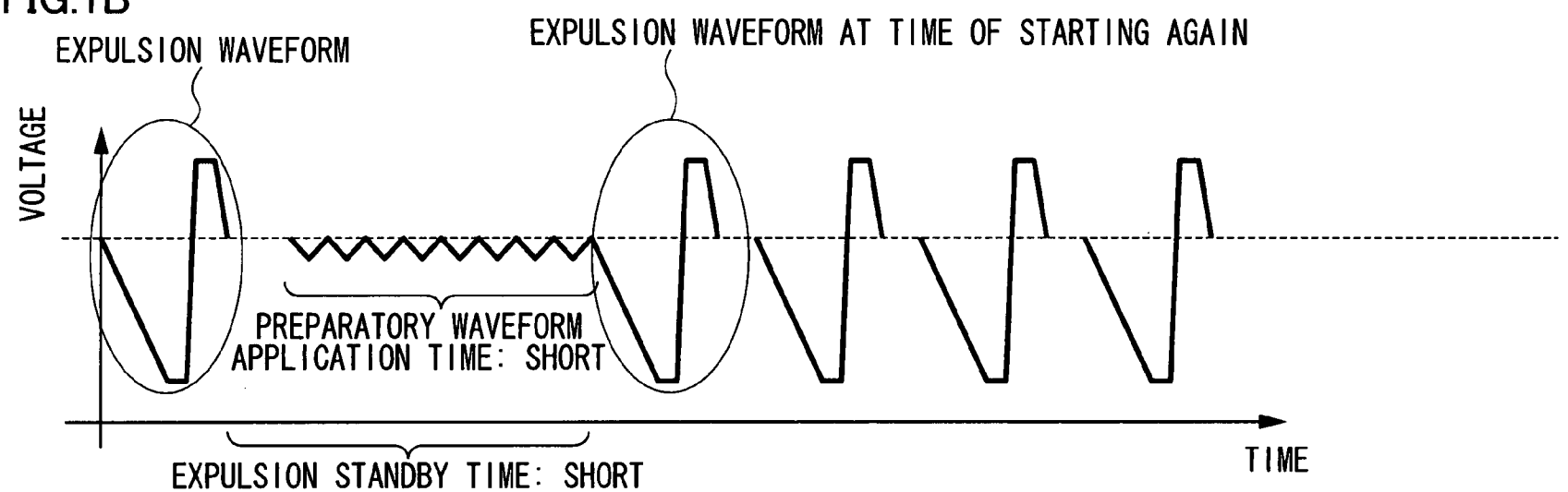
FIG. 1B is a drawing showing a preparatory waveform in a case in which the expulsion standby time is short, in the inkjet recording head relating to the first embodiment of the present invention.

As shown in FIG. 1B, if the expulsion standby time is short, the viscosity of the ink in the vicinity of the meniscus 40 increases, but does not increase that much as compared with a case in which the standby time is long. Therefore, the controller 24 applies a continuous preparatory waveform to the driving element 58 (see FIG. 2A) for a short time. By vibrating the meniscus 40 a proper degree in this way, the expulsion speed of the first drop at the time when expelling is started again is made to be 70% of the expulsion speed at the time of continuous expulsion.

Due to the controller 24 controlling the length of the time of application of the preparatory waveform on the basis of the liquid drop expulsion standby time in this way, the expulsion speed of the first drop at the time that expelling is started again can be made to be 70% of the expulsion speed at the time of continuous expulsion. The image quality at the time of starting expulsion again can thereby be improved.

A second embodiment of an inkjet recording device, in which an inkjet recording head of the present invention is employed, will be described next in accordance with FIGS. 6A and 6B.

Note that the same members as those of the first embodiment are denoted by the same reference numerals, and description thereof is omitted.

Figure 6A:
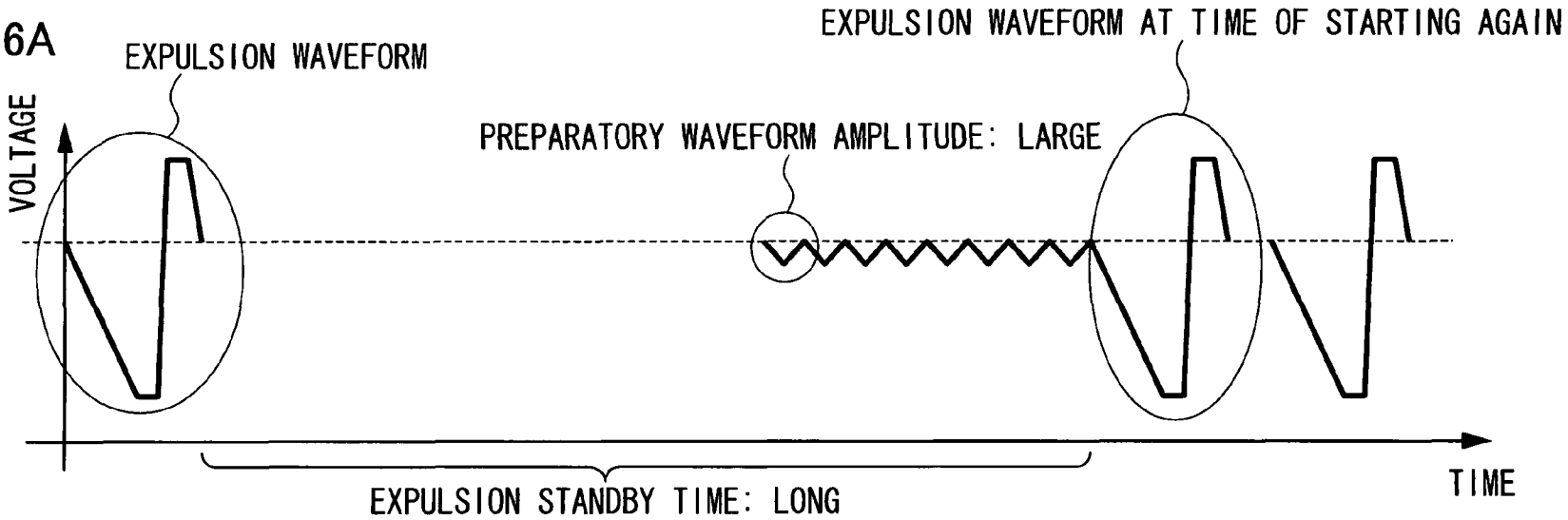
FIG. 6A is a drawing showing a preparatory waveform in a case in which the expulsion standby time is long, in an inkjet recording head relating to a second embodiment of the present invention.
Figure 6B:
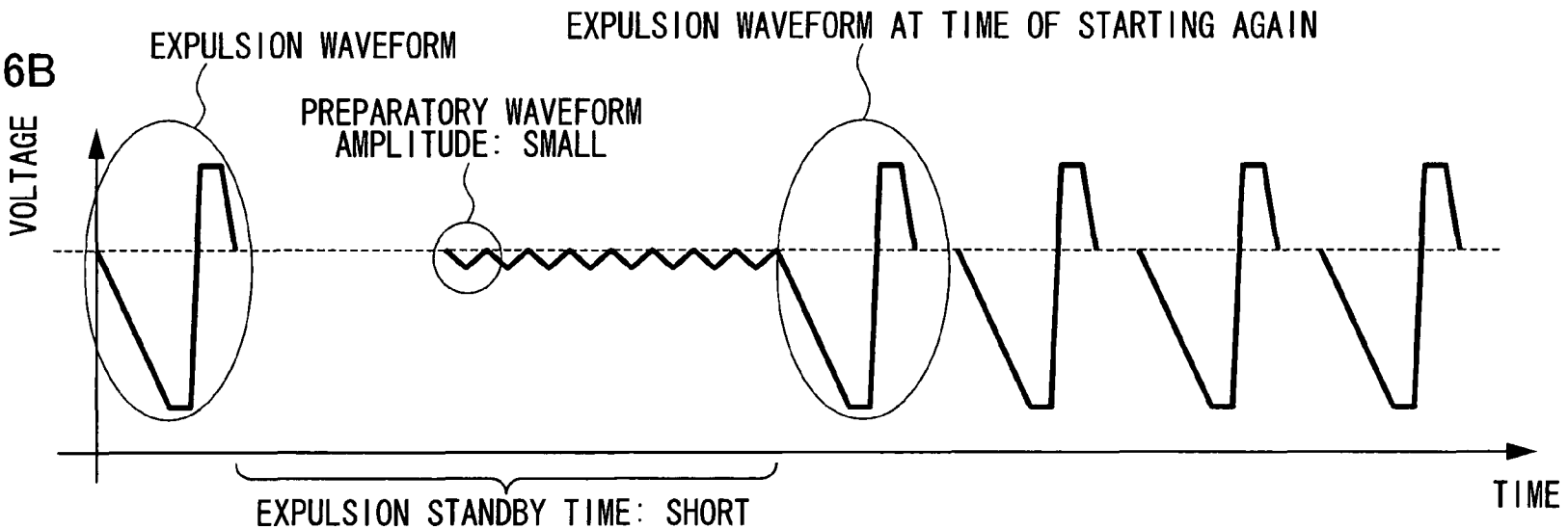
FIG. 6B is a drawing showing a preparatory waveform in a case in which the expulsion standby time is short, in the inkjet recording head relating to the second embodiment of the present invention.

As shown in FIGS. 6A and 6B, in the present embodiment, the application time of the preparatory waveform is constant, and instead, by controlling the amplitude of the preparatory waveform, the expulsion speed of the liquid drops at the time of starting expulsion again is made to be 70% of the expulsion speed at the time of continuous expulsion as in the first embodiment.

Concretely, as shown in FIG. 6A, if the expulsion standby time is long, the viscosity of the ink in the vicinity of the meniscus 40 increases, and therefore, the controller 24 apples a preparatory waveform of a large amplitude to the driving element 58 (see FIG. 2A). By greatly vibrating the meniscus 40 in this way, the expulsion speed of the first drop at the time of starting expulsion again is made to be to 70% of the expulsion speed at the time of continuous expulsion.

Further, as shown in FIG. 6B, if the expulsion standby time is short, the viscosity of the ink the vicinity of the meniscus 40 increases, but does not increase that much as compared with a case in which the standby time is long. Therefore, the controller 24 applies a preparatory waveform having a small amplitude to the driving element 58 (see FIG. 2A). By vibrating the meniscus 40 a proper degree in this way, the expulsion speed of the first drop at the time when expelling is started again is made to be 70% of the expulsion speed at the time of continuous expulsion.

Due to the controller 24 controlling the amplitude of the preparatory waveform on the basis of the liquid drop expulsion standby time in this way, the expulsion speed of the first drop at the time that expelling is started again can be made to be 70% of the expulsion speed at the time of continuous expulsion. The image quality at the time of starting expulsion again can thereby be improved.

A third embodiment of an inkjet recording device, in which an inkjet recording head of the present invention is employed, will be described next in accordance with FIGS. 7A and 7B.

Note that the same members as those of the first embodiment are denoted by the same reference numerals, and description thereof is omitted.

Figure 7A:
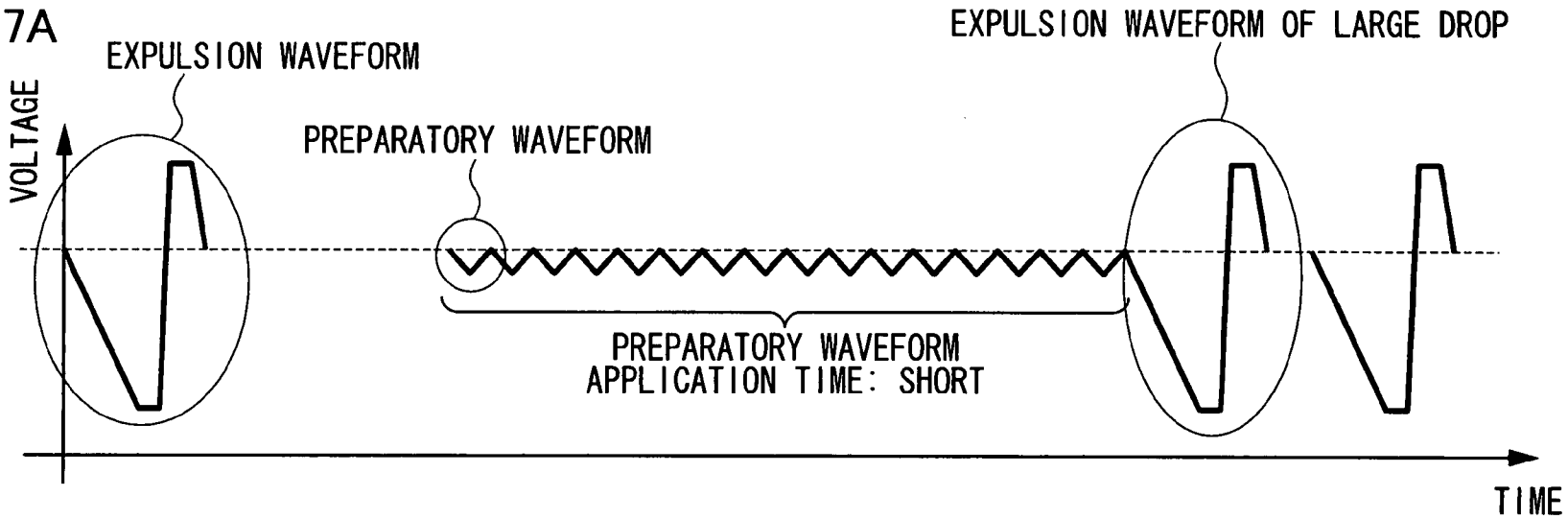
FIG. 7A is a drawing showing a preparatory waveform in a case in which the liquid drop at the time when expulsion starts again is a large drop, in an inkjet recording head relating to a third embodiment of the present invention.
Figure 7B:
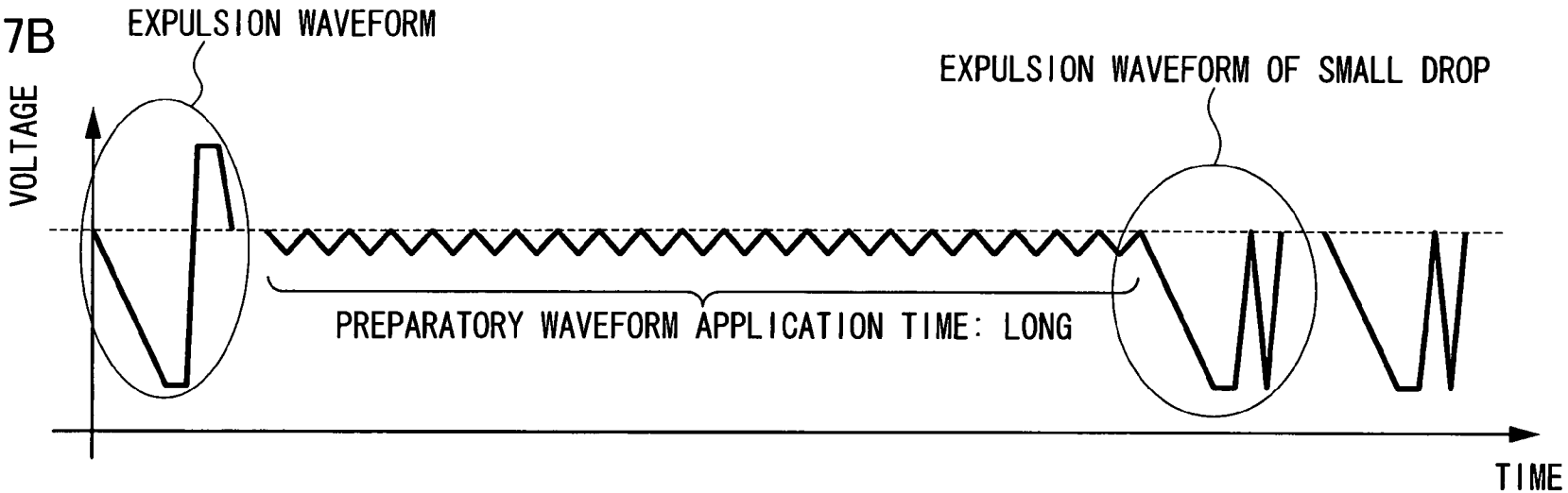
FIG. 7B is a drawing showing a preparatory waveform in a case in which the liquid drop at the time when expulsion starts again is a small drop, in the inkjet recording head relating to the third embodiment of the present invention.

As shown in FIGS. 7A and 7B, in the present embodiment, the controller 24 does not control the application time of the preparatory waveform on the basis of the expulsion standby time as in the first embodiment. Instead, by controlling the application time of the preparatory waveform on the basis of the liquid drop amount at the time of starting expulsion again, which is judged in accordance with the image information, the expulsion speed of the first drop at the time of starting expulsion again is made to be 70% of the expulsion speed at the time of continuous expulsion.

Concretely, as shown in FIG. 7A, if the liquid drop which is the first drop at the time when expulsion starts again is a large drop, the expulsion force is great, and the effect of an increase in ink viscosity in a vicinity of the meniscus 40 on the expulsion speed is small. Therefore, the controller 24 applies a preparatory waveform to the driving element 58 for a short time. By vibrating the meniscus 40 a proper degree in this way, the expulsion speed of the first drop at the time of starting expulsion again is made to be to 70% of the expulsion speed at the time of continuous expulsion.

Further, as shown in FIG. 7B, if the liquid drop which is the first drop at the time when expulsion starts again is a small drop, the expulsion force is small, and the effect of an increase in ink viscosity in a vicinity of the meniscus 40 on the expulsion speed is great. Therefore, the controller 24 applies a preparatory waveform to the driving element 58 for a long time. By sufficiently vibrating the meniscus 40 in this way, the expulsion speed of the first drop at the time of starting expulsion again is made to be to 70% of the expulsion speed at the time of continuous expulsion.

A fourth embodiment of an inkjet recording device, in which an inkjet recording head of the present invention is employed, will be described next in accordance with FIGS. 8A and 8B.

Note that the same members as those of the first embodiment are denoted by the same reference numerals, and description thereof is omitted.

Figure 8A:
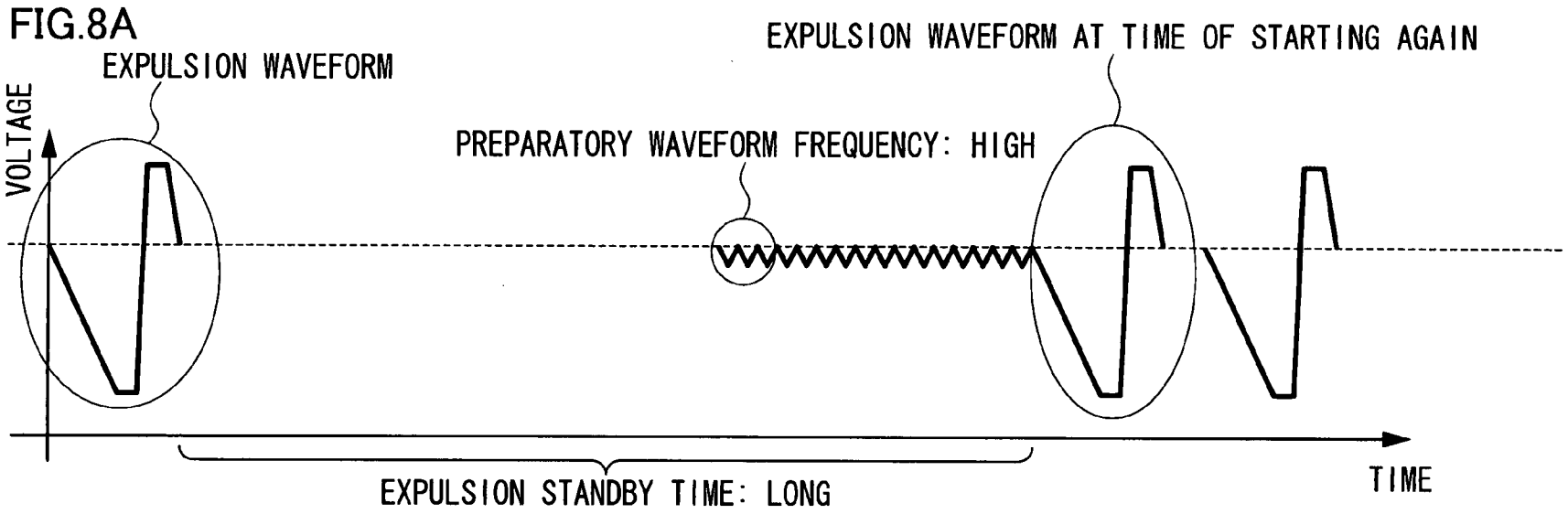
FIG. 8A is a drawing showing a preparatory waveform in a case in which the expulsion standby time is long, in an inkjet recording head relating to a fourth embodiment of the present invention.
Figure 8B:
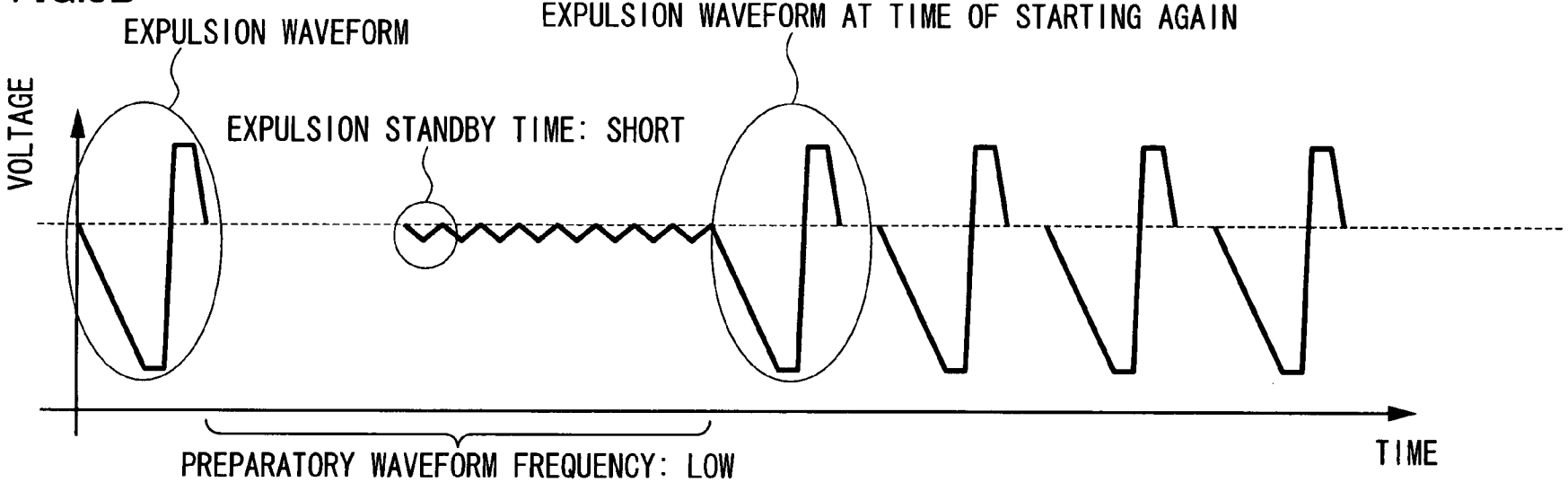
FIG. 8B is a drawing showing a preparatory waveform in a case in which the expulsion standby time is short, in the inkjet recording head relating to the fourth embodiment of the present invention.

As shown in FIGS. 8A and 8B, in the present embodiment, the application time of the preparatory waveform is constant, and instead, by controlling the frequency of the preparatory waveform, the expulsion speed of the first drop at the time of starting expulsion again is made to be 70% of the expulsion speed at the time of continuous expulsion as in the first embodiment.

Concretely, as shown in FIG. 8A, if the expulsion standby time is long, the viscosity of the ink in the vicinity of the meniscus 40 increases, and therefore, the controller 24 applies a preparatory waveform of a high frequency to the driving element 58 (see FIG. 2A). By sufficiently vibrating the meniscus 40 in this way, the expulsion speed of the first drop at the time of starting expulsion again is made to be to 70% of the expulsion speed at the time of continuous expulsion.

Further, as shown in FIG. 8B, if the expulsion standby time is short, the viscosity of the ink the vicinity of the meniscus 40 increases, but does not increase that much as compared with a case in which the standby time is long. Therefore, the controller 24 applies a preparatory waveform of a low frequency to the driving element 58 (see FIG. 2A). By vibrating the meniscus 40 a proper degree in this way, the expulsion speed of the first drop at the time when expelling is started again is made to be 70% of the expulsion speed at the time of continuous expulsion.

Note that, although the present invention has been described in detail with reference to specific embodiments, the present invention is not to be limited to these embodiments, and it will be clear to those skilled in the art that various other embodiments are possible within the scope of the present invention. For example, in the above-described embodiment, the expulsion speed of the first drop at the time when expulsion is started again is controlled by controlling the frequency of the preparatory waveform. However, the expulsion speed of the first drop when expulsion is again started may be controlled by controlling, in combination, the application time of the preparatory waveform, the amplitude of the preparatory waveform, and the frequency of the preparatory waveform.

Further, by optimizing the preparatory waveform shown in the above-described embodiments, excessive application of vibration can be prevented, and therefore, there is also the effect that deterioration of the vibrating element can be prevented.

What is claimed is:

1. A liquid drop expelling head comprising:

a driving element generating a pressure wave at a liquid within a pressure chamber, and expelling a liquid drop from a nozzle which communicates with the pressure chamber; and a control section applying a driving waveform based on image information to the driving element, and controlling a preparatory waveform, which vibrates a meniscus of the nozzle, on the basis of both a duration of a liquid drop expulsion standby time and a liquid drop amount of a first drop at a time of starting expulsion again;

wherein the preparatory waveform is separate from the driving waveform, the preparatory waveform is applied during an expulsion standby time, and the preparatory waveform vibrates the meniscus of the nozzle without ejecting ink.

2. The liquid drop expelling head of claim 1, wherein the control section controls a time of application of the preparatory waveform which is applied to the driving element.

3. The liquid drop expelling head of claim 1, wherein the control section controls an amplitude of the preparatory waveform which is applied to the driving element.

4. The liquid drop expelling head of claim 1, wherein the control section controls a frequency of the preparatory waveform which is applied to the driving element.

5. The liquid drop expelling head of claim 1, wherein the control section controls an expulsion speed of the first drop at the time of starting expulsion again by controlling, in combination, a time of application of the preparatory waveform which is applied to the driving element, an amplitude of the preparatory waveform, and a frequency of the preparatory waveform.

6. An image forming device using the liquid drop expelling head of claim 1.

7. The liquid drop expelling head of claim 1, wherein the control section outputs a preparatory waveform which is such that an expulsion speed of the first drop at the time of starting expulsion again after an expulsion standby time is approximately 70% of an expulsion speed at a time of continuous expulsion.

8. The liquid drop expelling head of claim 7, wherein the control section controls a time of application of the preparatory waveform which is applied to the driving element.

9. The liquid drop expelling head of claim 7, wherein the control section controls an amplitude of the preparatory waveform which is applied to the driving element.

10. The liquid drop expelling head of claim 7, wherein the control section controls a frequency of the preparatory waveform which is applied to the driving element.

11. The liquid drop expelling head of claim 7, wherein the control section controls the expulsion speed of the first drop at the time of starting expulsion again by controlling, in combination, a time of application of the preparatory waveform which is applied to the driving element, an amplitude of the preparatory waveform, and a frequency of the preparatory waveform.

12. An image forming device using the liquid drop expelling head of claim 7.

* * * * *